US007553134B2

(12) United States Patent
Uno et al.

(10) Patent No.: US 7,553,134 B2
(45) **Date of Patent: *Jun. 30, 2009**

(54) SWITCH VALVE STRUCTURE OF FLUID MACHINE

(75) Inventors: Keiichi Uno, Kariya (JP); Shigeki Iwanami, Okazaki (JP); Mikio Matsuda, Nishio (JP); Hiroshi Ogawa, Nishio (JP)

(73) Assignees: DENSO CORPORATION, Kariya (JP); Nippon Soken, Inc., Nishio (JP)

( * ) Notice: Subject to any disclaimer, the term of this patent is extended or adjusted under 35 U.S.C. 154(b) by 303 days.

This patent is subject to a terminal disclaimer.

(21) Appl. No.: 11/091,451

(22) Filed: Mar. 29, 2005

(65) Prior Publication Data

US 2005/0220642 A1 Oct. 6, 2005

(30) Foreign Application Priority Data

Mar. 31, 2004 (JP) ..... 2004-104818

(51) Int. Cl.
*F04B 49/00* (2006.01)
*F04B 17/00* (2006.01)

(52) U.S. Cl. ..... 417/310; 417/440; 417/311; 417/307; 417/308; 417/410.5

(58) Field of Classification Search ..... 417/218, 417/310, 374, 410.5, 440, 304, 307, 308, 417/311

See application file for complete search history.

(56) References Cited

U.S. PATENT DOCUMENTS 4,505,651 A 3/1985 Terauchi et al.

(Continued)

FOREIGN PATENT DOCUMENTS

| | | |
|---|---|---|
| CN | A-1292850 | 4/2001 |
| JP | B1-45-005710 | 2/1970 |
| JP | A-56-072281 | 6/1981 |
| JP | U-58-116745 | 8/1983 |
| JP | A-62-4972 | 1/1987 |
| JP | A-03-124982 | 5/1991 |

(Continued)

OTHER PUBLICATIONS

Notice of Reasons for Rejection mailed Oct. 2, 2007 in corresponding Japanese Patent Application No. 2004-104818 (and English translation).

(Continued)

*Primary Examiner*—Devon C Kramer
*Assistant Examiner*—Leonard J Weinstein
(74) *Attorney, Agent, or Firm*—Posz Law Group, PLC

(57) ABSTRACT

A switch valve structure of a fluid machine (10) having a pump mode to operate as a compressor and a motor mode to operate as an expander is disclosed. In pump mode, a communication path (106) between a working chamber (V) and a high-pressure chamber (104) is closed, while in motor mode, the communication path (106) is opened by a valve unit (107*d*). The valve unit (107*d*) is includes a spool portion (117) sliding in the direction substantially perpendicular to the surface to which the communication path (106) opens and a valve portion (127) arranged at the forward end of the spool portion (127) and sliding with the spool portion (117) thereby to open/close the communication path (106). A swivel mechanism (137) is interposed between the spool portion (117) and the valve portion (127) to tilt the sliding axis of the valve portion (127) at an arbitrary angle with respect to the sliding axis of the spool portion (117).

5 Claims, 8 Drawing Sheets

U.S. PATENT DOCUMENTS

| | | | | |
|---|---|---|---|---|
| 4,586,533 | A | 5/1986 | Estes | |
| 4,744,733 | A | 5/1988 | Terauchi et al. | |
| 4,840,545 | A * | 6/1989 | Moilanen | 417/301 |
| 5,049,044 | A * | 9/1991 | Hirano | 417/310 |
| 5,452,989 | A * | 9/1995 | Rood et al. | 417/29 |
| 5,567,131 | A | 10/1996 | McNaull | |
| 5,738,333 | A * | 4/1998 | Cognevich et al. | 251/61.2 |
| 5,873,707 | A * | 2/1999 | Kikuchi | 417/309 |
| 6,095,765 | A | 8/2000 | Khalifa | |
| 6,190,138 | B1 * | 2/2001 | Hugenroth et al. | 417/310 |
| 6,247,899 | B1 * | 6/2001 | Ban et al. | 417/16 |
| 6,619,929 | B2 * | 9/2003 | Adaniya et al. | 417/223 |
| 6,846,166 | B2 * | 1/2005 | Kinugawa | 417/395 |
| 2004/0184923 | A1 * | 9/2004 | Iwanami et al. | 417/221 |
| 2005/0013701 | A1 * | 1/2005 | Yamanouchi et al. | 417/297 |

FOREIGN PATENT DOCUMENTS

| | | |
|---|---|---|
| JP | A-07-127583 | 5/1995 |
| JP | B-2540738 | 10/1996 |
| JP | B2-2770980 | 4/1998 |
| JP | A-2001-173582 | 6/2001 |
| JP | A-2004-232492 | 8/2004 |

OTHER PUBLICATIONS

Notice of Reasons for Rejection dated Nov. 13, 2007 in corresponding German Patent Application No. 05 014 130.7 (and English translation).

Chinese publication published on Jan. 14, 2009 in corresponding Chinese patent application No. CN 100451296C (and English translation).

* cited by examiner

SWITCH VALVE STRUCTURE OF FLUID MACHINE

BACKGROUND OF THE INVENTION

1. Field of the Invention

The present invention relates to a switch valve structure for switching a fluid machine between a pump mode, to pressurize and discharge a fluid, and a motor mode to convert the fluid pressure at the time of expansion into the kinetic energy and output the mechanical energy.

2. Description of the Related Art

In a conventional vapor compression refrigerator constituting a fluid machine using the Rankine cycle, the compressor of the vapor compression refrigerator can double as an expander to recover energy from the Rankine cycle as disclosed, for example, in Japanese Patent Publication No. 2540738.

In a compressor, the mechanical energy is applied from an external source and a gas such as a gas-phase refrigerant is sucked into a working chamber, after which the volume of the working chamber is reduced to compress and discharge the gas. In an expander, on the other hand, a high-pressure gas is allowed in the working chamber and is expanded by the gas pressure thereby to recover the mechanical energy. To use a compressor as an expander, therefore, the refrigerant flow must be reversed.

In the prior art described above, however, the refrigerant inlet and the refrigerant outlet of the expander (compressor) to recover energy are set on the same side as the refrigerant inlet and the refrigerant outlet of the compressor (expander) to exhibit the refrigeration capacity of the vapor compression refrigerator. Therefore, a single compressor cannot be operated as an expander. In fact, one of the Rankine cycle and the vapor compression refrigerator cannot normally operate.

Specifically, in the compressor, a gas is compressed by displacing a movable member such as a piston or a movable scroll and reducing the volume of the working chamber. Therefore, the discharge port for communication between the working chamber and a high-pressure chamber (discharge chamber) has a check valve to prevent the gas from flowing reversely from the high-pressure chamber to the working chamber.

In the expander, on the other hand, a mechanical output is obtained by allowing a high-pressure gas to flow into the working chamber from the high-pressure chamber and thus displacing a movable member. The mere reversal of the inlet and the outlet of the gas, therefore, cannot supply the high-pressure gas into the working chamber in view of the fact that the check valve poses a stumbling block when the compressor is operated as an expander. The means for reversing the inlet and the outlet of a gas, therefore, cannot operate the compressor as an expander.

In view of this situation, the present inventors earlier conceived a fluid machine (compressor) comprising a high-pressure chamber having a valve mechanism which can be switched to use the fluid machine as a compressor and as an expander (Japanese Patent Application No. 2003-19139).

Specifically, as shown in FIG. 10, a fluid machine 10 includes a pump motor mechanism 100 (similar to the well-known scroll compression mechanism) which is configured of a communication path 106 between a working chamber V and a high-pressure chamber 104 and a spool 107*d* to open/close the communication path 106. In the case where the pump motor mechanism 100 is used as a compressor, the communication path 106 is closed by the spool 107*d*, so that the refrigerant flowing in from a low-pressure port 111 is compressed in the working chamber V and discharged from a high-pressure port 110 through a discharge port 105 and a high-pressure chamber 104 (with a check valve 107*a* opened). In the case where the pump motor mechanism 100 is operated as an expander, on the other hand, the communication path 106 is opened by the spool 107*d*, so that the vapor refrigerant is allowed to flow in from the high-pressure port 110 (with the check valve 107*d* closed), and is expanded in the working chamber V through the high-pressure chamber 104 and the communication path 106. Thus, the refrigerant reduced in pressure is allowed to flow out from the low-pressure port 111.

As a result, a fluid machine 10 is obtained which can be used as a compressor and as an expander by reversing the refrigerant flow.

In the valve mechanism described above, however, the spool 107*d* is slid longitudinally and the communication path 106 open to the flat surface of the mating part is sealed by the flat surface portion at the forward end of the spool 107*d*. In the case where the perpendicularity between the direction in which the spool 107*d* slides and the surface to which the communication path 106 is open is low in accuracy, therefore, the sealability is difficult to secure. A low sealability would cause a leak from the communication path 106 closed by the spool 107*d*, and the fluid compressed by the pump motor mechanism 100 would flow in reverse direction into the working chamber V from the high-pressure chamber 104. This fluid would require compression again, resulting in the power loss of the pump motor mechanism 100.

SUMMARY OF THE INVENTION

In view of the problem described above, the object of this invention is to provide a switch valve structure of a fluid machine, having a spool as a constituent member, able to positively secure the sealability.

In order to achieve the object described above, according to this invention, there is provided a switch valve structure of a fluid machine (10) having a pump mode to discharge a fluid under pressure and a motor mode to output mechanical energy by converting the fluid pressure at the time of expansion into kinetic energy wherein, in the case where the pump mode is executed, a communication path (106) between a high-pressure chamber (104) and a working chamber (V) of the fluid machine (10) is closed, while in motor mode, the communication path (106) is opened by a valve unit (107*d*) The valve unit (107*d*) includes a spool portion (117) adapted to slide in the direction substantially perpendicular to the surface to which the valve unit (107*d*) side of the communication path (106) is open, and a valve portion (127) arranged at the forward end of the spool portion (117) and adapted to slide with the spool portion (117) for opening/closing the communication path (106). A swivel mechanism (137) adapted to tilt the sliding axis of the valve portion (127) at an arbitrary angle with respect to the sliding axis of the spool portion (117) is arranged between the spool portion (117) and the valve portion (127).

As a result, even in the case where the perpendicularity of the sliding axis of the spool portion (117) with respect to the surface to which the communication path (106) opens is low in accuracy, the valve portion (127) can be brought in contact with the surface to which the communication path (106) opens, by the swivel mechanism (137), and therefore the sealability is improved.

According to this invention, the swivel mechanism (137) preferably includes a protrusion (137) formed on one of the spool portion (117) and the valve portion (127) and protruding toward the other.

According to this invention, the protrusion (137) is preferably formed as a spherical surface so that the tilt angle of the sliding axis of the valve portion (127) with respect to the sliding axis of the spool portion (117) can be smoothly changed.

According to this invention, the spherical shape of the protrusion (137) can be easily formed by a spherical member (137) fitted under pressure in one of the spool portion (117) and the valve portion (127).

According to this invention, a selected one of the spool portion (117) and the valve portion (127) on which the protrusion (137) is not formed is formed with a depression (117*c*) into which a part of the protrusion (137) is inserted, thereby making it possible to set the spool portion (117) and the valve portion (127) in relative positions and prevent the displacement between the spool portion (117) and the valve portion (127).

According to this invention, the protrusion (137) and the depression (117*c*) can be formed as a universal joint with spherical surfaces in contact with each other.

According to this invention, a seal member (147) is preferably interposed between the spool portion (117) and a guide portion (107*f*) to guide the sliding motion of the spool portion (117).

As a result, the high-pressure fluid in the high-pressure chamber (104) is prevented from leaking to the guide portion (107*f*), thereby reducing the power loss of the fluid machine (10).

According to this invention, the spool portion (117) and the valve portion (127) are preferably connected to each other by a coupling mechanism (127*a*, 157).

As a result, the spool portion (117) and the valve portion (127) can be slid by a single drive means.

Specifically, according to this invention, the coupling mechanism (127*a*, 157) preferably includes a flange (127*a*) arranged on a selected one of the spool portion (117) and the valve portion (127) and a stop ring (157) arranged on the other one of the spool portion (117) and the valve portion (127) to thereby easily prevent said one of the spool portion (117) and the valve portion (127) from coming off when the flange (127*a*) comes into contact.

According to this invention, the opening (106*a*) on the valve unit (107*d*) side of the communication path (106) is formed in the shape of a circle, the valve unit (107*d*) slides in the direction substantially perpendicular to the imaginary surface of the opening (106*a*), and the opening (106*a*) side of the valve unit (107*d*) is formed as a spherical surface having a diameter larger than the opening (106*a*).

As a result, even in the case where the perpendicularity of the sliding axis of the valve unit (107*d*) with respect to the imaginary surface of the opening (106*a*) is low in accuracy, the opening (106*a*) and the spherical surface of the valve unit (107*d*) are positively in contact with each other (linear hermetical contact) at the circumference. Thus, the sealability is improved.

According to this invention, in the case where the communication path (106) is formed diagonally with respect to the sliding direction of the valve unit (107*d*), the opening (106*a*) can be formed as a circle with a bush (106*b*). Also, the material of the bush (106*d*) can be selected in accordance with the material of the valve unit (107*d*), thereby further improving the sealability and durability.

Further, according to this invention, a chamfer (106*c*) is preferably formed on the circumference of the opening (106*a*) thereby to further improve the sealability.

Incidentally, the reference numerals in the parentheses following the names of the means described above indicate an example of the correspondence with specific means described in the embodiments described later.

The present invention may be more fully understood from the description of preferred embodiments of the invention, as set forth below, together with the accompanying drawings.

DESCRIPTION OF THE PREFERRED EMBODIMENTS

First Embodiment

According to this embodiment, an expander-integrated compressor (fluid machine) 10 arranged in a vapor compression refrigerator having the Rankine cycle includes a switch valve structure according to the invention.

In the vapor compression refrigerator having the Rankine cycle, energy is recovered from the waste heat generated in an engine constituting a thermal engine 20 to generate the drive power of a vehicle while, utilizing the cold and the heat generated by the vapor compression refrigerator for air-conditioning. The vapor compression refrigerator having the Rankine cycle is briefly explained below.

Figure 1:
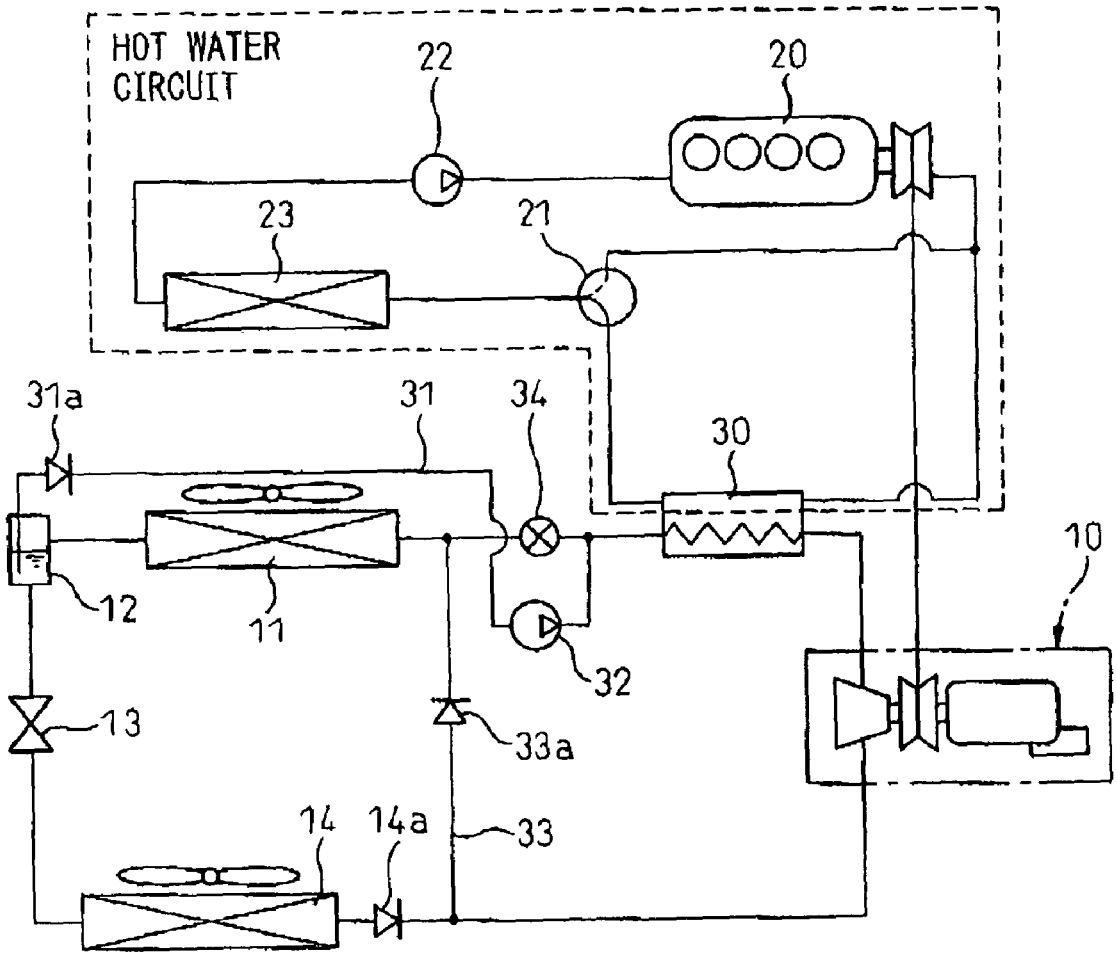
FIG. 1 is schematic diagram showing a vapor compression refrigerator using the Rankine cycle according to an embodiment of the invention.

As shown in FIG. 1, the expander-integrated compressor 10 is a fluid machine having a pump mode to pressurize and discharge a gas-phase refrigerant on the one hand and a motor mode to convert the fluid pressure at the time of expansion of a superheated vapor refrigerant into kinetic energy and output the mechanical energy on the other hand. A heat radiator 11 is a cooling device connected to the discharge side (a high-pressure port 110 described later) of the expander-integrated compressor 10 to radiate heat while at the same time cooling the refrigerant. The expander-integrated compressor 10 is explained in detail later.

A gas-liquid separator 12 is a receiver to separate the refrigerant flowing out of the heat radiator 11 into a gas-phase refrigerant and a liquid-phase refrigerant. A decompressor 13 expands and reduces the pressure of the liquid-phase refrigerant separated by the gas-liquid separator 12. According to this embodiment, a temperature-type expansion valve is employed in which the refrigerant is reduced in pressure in isoentropic fashion, and while the expander-integrated compressor 10 is operating in pump mode, the aperture opening is controlled in such a manner that the superheat degree of the refrigerant sucked in the expander-integrated compressor 10 reaches a predetermined value.

An evaporator 14 is a heat absorber to exhibit a heat-absorbing function by evaporating the refrigerant decompressed by the decompressor 13, A check valve 14*a* allows the refrigerant to flow from the refrigerant outlet of the evaporator 14 only to the refrigerant inlet (a low-pressure port 111 described later) while the expander-integrated compressor 10 operates in pump mode.

The expander-integrated compressor 10, the heat radiator 11, the gas-liquid separator 12, the decompressor 13 and the evaporator 14 make up a vapor compression refrigerator to move heat from low temperature side to high temperature side.

A heater 30 is arranged in a refrigerant circuit connecting the expander-integrated compressor 10 and the heat radiator 11. The heater 30 is a heat exchanger in which the refrigerant flowing in the refrigerant circuit and the engine cooling water exchange heat with each other thereby to heat the refrigerant. A three-way valve 21 switches the operation to one of the mode in which the engine cooling water flowing out of the engine 20 is circulated in the heater 30 and the mode in which the engine cooling water is not so circulated. The three-way valve 21 is controlled by an electronic control unit not shown.

A first bypass circuit 31 is a refrigerant path to lead the liquid-phase refrigerant separated in the gas-liquid separator 12 to the refrigerant inlet side of the heat radiator 11 of the heater 30. This first bypass circuit 31 has arranged therein a liquid pump 32 to circulate the liquid-phase refrigerant and a check valve 31*a* which allows the refrigerant to flow from the gas-liquid separator 12 only to the heater 30. According to this embodiment, the liquid pump 32 is an electrically-operated pump and is controlled by an electronic control unit not shown.

A second bypass circuit 33 is a refrigerant path connecting the refrigerant outlet of the expander-integrated compressor 10 (the low-pressure port 111 described later) and the refrigerant inlet of the heat radiator 11 when the expander-integrated compressor 10 operates in motor mode. The second bypass circuit 33 includes a check valve 33*a* allowing the refrigerant to flow from the expander-integrated compressor 10 only to the refrigerant inlet of the heat radiator 11.

The operating valve 34 is an electromagnetic valve to open/close the refrigerant path and, being inserted between the heat radiator 11 and the heater 30, is controlled by an electronic control unit not shown.

The heat radiator 11 of the vapor compression refrigerator is shared by the gas-liquid separator 12, the liquid pump 32, the heater 30 and the expander-integrated compressor 10 to constitute the Rankine cycle to recover energy from the waste heat generated in the engine 20.

Incidentally, a water pump 22 circulates the engine cooling water, and a radiator 23 is a heat exchanger to cool the engine cooling water by heat exchange between the engine cooling water and the atmospheric air. The water pump 22 is a mechanical pump operated by the drive power from the engine 20 but may, alternatively, be an electrically-operated pump driven by an electric motor.

Next, the expander-integrated compressor 10 is explained in detail with reference to FIG. 2. The expander-integrated compressor 10 is configured of a pump motor mechanism 100 to compress or expand a fluid (a gas-phase refrigerant in this embodiment), a rotary electric machine 200 to output the electric energy from the rotation energy input thereto and to output the rotation energy from the electric power input thereto, an electromagnetic clutch 300 making up a power transmission mechanism to transmit the power interruptibly from the engine 20 to the pump motor mechanism 100, and a speed change mechanism 400 including a planetary gear mechanism to switch the power transmission path between the pump motor mechanism 100, the rotary electric machine 200 and the electromagnetic clutch 300 and to transmit by decreasing or increasing the rotational speed of the rotational power thereof.

The rotary electric machine 200 includes a stator 210 and a rotor 220 rotated in the stator 210, and is accommodated in a stator housing 230. The stator 210 is wound with a stator coil, and the rotor 220 is a magnet rotor with a permanent magnet buried therein.

According to this embodiment, the rotary electric machine 200 operates as an electric motor to drive the pump motor mechanism 100 by rotating the rotor 220, in the case where electric power is supplied to the stator 210, and it operates as a generator to generate electric power in the case where the torque to rotate the rotor 220 is input thereto.

The electromagnetic clutch 300 includes a pulley unit 310 to receive the driving power from the engine 20 through a V belt, an exciting coil 320 to generate a magnetic field and a friction plate 330 displaced by the electromagnetic force of the magnetic field induced by the exciting coil 320. In the case where the engine 20 is connected to the expander-integrated compressor 10, the exciting coil 320 is energized, while the exciting coil 320 is deactivated to disconnect the expander-integrated compressor 10 from the engine 20.

The pump motor mechanism 100 has the same structure as a well-known scroll compression mechanism. Specifically, the pump motor mechanism 100 includes a fixed scroll (housing) 102 fixed on the stator housing 230 through a middle housing 101, a swivel scroll 103 making up a movable member adapted to be displaced by being swiveled in the space between the middle housing 101 and the fixed scroll 102, and a valve mechanism 107 to open/close the communication paths 105, 106 between the working chamber V and the high-pressure chamber 104.

The fixed scroll 102 includes a tabular base portion 102*a* and a spiral toothed portion 102*b* protruded from the tabular base portion 102*a* toward the swivel scroll 103. The swivel scroll 103, on the other hand, includes a spiral toothed-portion 103*b* in mesh with the toothed portion 102*b* and a base portion 103*a* formed with the toothed portion 103*b*. In the case where the swivel scroll 103 rotates with the toothed portions 102*b*, 103*b* in contact with each other, the volume of the working chamber v formed by the scrolls 102, 103 is increased or decreased.

A shaft 108 is a crankshaft having an eccentric portion 108*a* eccentric with respect to the center axis of rotation at a first longitudinal end thereof. This eccentric portion 108*a* is connected to the swivel scroll 103 through a bushing 103*d* and a bearing 103*c*.

An anti-rotation mechanism 109 causes the swivel scroll 103 to make one rotation around the eccentric portion 108*a* during one rotation of the shaft 108. With the rotation of the shaft 108, therefore, the swivel scroll 103 orbits, without rotating, around the center axis of rotation of the shaft 108. The volume of the working chamber V decreases progressively according as the swivel scroll 103 is displaced more from the outer diameter side toward the center thereof. On the contrary, the volume of the working chamber v increases progressively according as the swivel scroll 103 is displaced more from the center toward the outer diameter side of the swivel scroll 103.

Also, the communication path 105 is a discharge port to discharge the compressed refrigerant by communication between the high-pressure chamber 104 and the working chamber V assuming the minimum volume in pump mode. The communication path 106, on the other hand, is an inflow port whereby the high-temperature, high-pressure refrigerant, i.e. the superheated vapor refrigerant, which has been led into the high-pressure chamber by communication between the high-pressure chamber 104 and the working chamber V assuming the minimum volume in motor mode, is led to the working chamber V.

The high-pressure chamber 104 has the function as a discharge chamber to smooth the pulsation of the refrigerant discharged from the communication path 105 (hereinafter referred to as the discharge port 105). The high-pressure chamber 104 includes a high-pressure port 110 connected to the heater 30 and the heat radiator 11.

The low-pressure port 111 connected to the evaporator 14 and the second bypass circuit 33 is arranged in the stator housing 230 and, through the interior of the stator housing 230, communicates with the space between the middle housing 101 and the fixed scroll 102.

The discharge valve 107*a* is a check valve like a reed valve arranged on the high-pressure chamber 104 side of the discharge port 105 to prevent the refrigerant discharged from the discharge port 105 from flowing in reverse direction from the high-pressure chamber 104 to the working chamber V. A stopper 107*b* is a valve stop plate to restrict the maximum opening degree of the discharge valve 107*a*. The discharge valve 107*a* and the stopper 107*b* are fixed on the base portion 102*a* by a bolt 107*c*.

The valve unit 107*d* is a switch valve to switch the pump mode and the motor mode by opening/closing the communication path 106 (hereinafter referred to as the inflow port 106). The electromagnetic valve 107*e* is a control valve to control the internal pressure of the back pressure chamber 107*f* by controlling the communication between the low-pressure port 111 and the back pressure chamber 107*f*. A spring 107*g* is an elastic means to apply elasticity to the valve unit 107*d* in the direction to close the inflow port 106. An aperture 107*h* is a resistance means to establish communication between the back pressure chamber 107*f* and the high-pressure chamber 104 with a predetermined path resistance.

If the electromagnetic valve 107*e* opens, the pressure of the back pressure chamber 107*f* is reduced below that of the high-pressure chamber 104, and the valve unit 107*d* is displaced rightward in FIG. 2 while shrinking the spring 107*g* under pressure. Thus, the inflow port 106 opens. The pressure loss in the aperture 107*h* is so great that the amount of the refrigerant flowing from the high-pressure chamber 104 into the back pressure chamber 107*f* is negligibly small.

Figure 2:
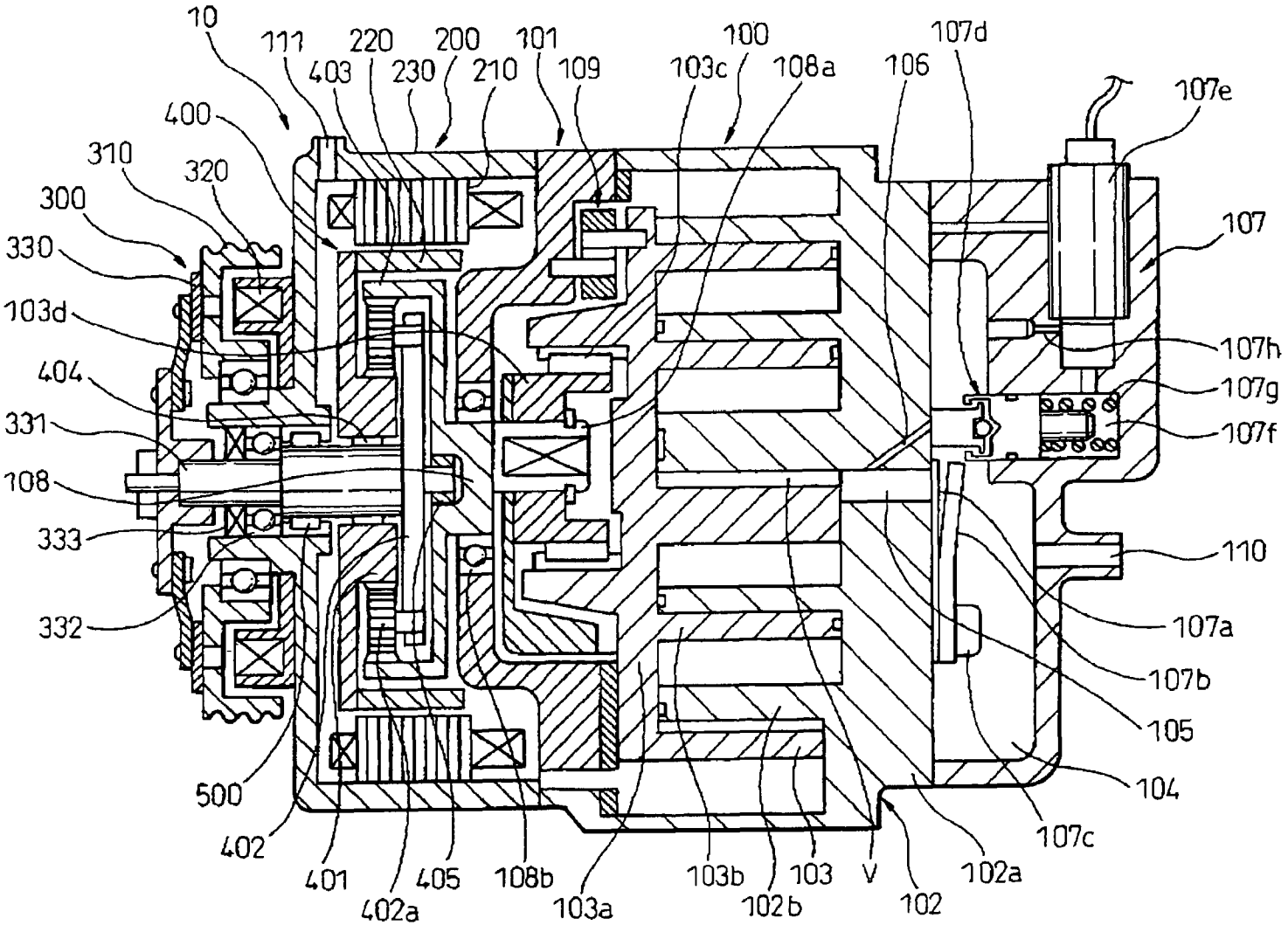
FIG. 2 is a sectional view showing an expander-integrated compressor according to a first embodiment of the invention.

On the contrary, if the electromagnetic valve 107*e* is closed, the pressure of the back pressure chamber 107*f* becomes equal to that of the high-pressure chamber 104, and the valve unit 107*d* is displaced leftward in FIG. 2 by the force of the spring 107*g*. Thus, the inflow port 106 is closed. In other words, the valve unit 107*d*, the electromagnetic valve 107*e*, the back pressure chamber 107*f*, the spring 107*g* and the aperture 107*h* make up an electrically operated valve of a pilot type to open and close the inflow port 106.

According to this invention, the structure of the valve unit 107*d* has a feature described in detail later.

The speed change mechanism 400 includes a sun gear 401 arranged at the central portion, a planetary carrier 402 connected to a pinion gear 402*a* rotated while orbiting along the outer periphery of the sun gear 401, and a ring gear 403 arranged on the outer periphery of the pinion gear 402*a*.

The sun gear 401 is integrated with the rotor 220 of the rotary electric machine 200. The planetary carrier 402 is integrated with a shaft 331 adapted to rotate integrally with a friction plate 330 of the electromagnetic clutch 300. Further, the ring gear 403 is integrated with a second longitudinal end (an the side far from the eccentric portion) of the shaft 108.

A one-way clutch 500 allows the shaft 331 to rotate only in one direction (in the direction in which the pulley unit 310 rotates). A bearing 332 supports the shaft 331 rotatably, and a bearing 404 supports the sun gear 401, i.e. the rotor 220 rotatably on the shaft 331. A bearing 405, on the other hand, supports the shaft 331 (planetary carrier 402) rotatably on the shaft 108. A bearing 108*b* supports the shaft 108 rotatably on the middle housing 101.

A lip seal 333 is a shaft seal unit to prevent the refrigerant from leaking out of the stator housing 230 from the gap between the shaft 331 and the stator housing 230.

Figure 3:
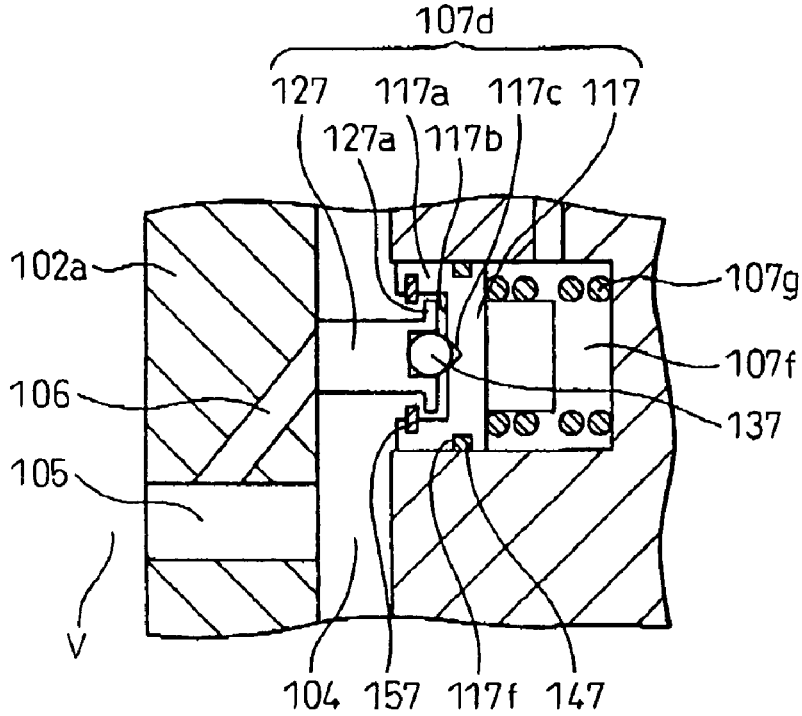
FIG. 3 is a sectional view showing a valve unit according to the first embodiment of the invention.

Next, the valve unit 107*d* making up the feature of the invention will be explained in detail. As shown in FIG. 3, the valve unit 107*d* includes a spool portion 117 sliding longitudinally along the inner peripheral surface of the back pressure chamber 107*f* (corresponding to the guide portion in the invention) as a guide, and a valve portion 127 adapted to open/close the communication path 106 at the forward end of the spool portion 117.

A cylindrical portion 117*a* is arranged at the forward end of the spool portion 117, and a valve receiving surface 117*b* is formed in the cylindrical portion 117*a*. A conical depression 117*c* is formed on the valve receiving surface 117*b*. The depth and the inclination of the depression 17*c* axe set so that a part of the forward end of the hard ball 137 of the valve portion 127 described later can be inserted.

A ring groove 117*f* is formed on the outer periphery of the spool portion 117. A piston ring 147 (corresponding to the seal member in this invention) is fixed in the ring groove 117*f* thereby to secure the sealability with the inner peripheral surface of the back pressure chamber 107*f*.

The valve portion 127 is a solid cylindrical member, and a flange 127*a* is formed at the outer peripheral end of the spool portion 117 side of the valve portion 127. A depression is formed on the end surface of the spool portion 117 side of the valve portion 127. The hard ball 137 is fitted under pressure in this depression thereby to form a spherical protrusion toward the spool portion 117.

The flange 127*a* of the valve portion 127 is inserted into the cylindrical portion 117*a* of the spool portion 117, and the hard ball 137 of the valve portion 127 is inserted in the depression 117*c* of the spool portion 117. While the hard ball 137 is in contact with the depression 117*c*, a gap is formed between the valve receiving surface 117*b* and the flange 127*a*. The depression 117*c* and the hard ball 137 correspond to the component members making up the swivel mechanism according to the invention.

Further, a stop ring 157 is mounted on the cylindrical portion 117*a* to form a gap with the flange 127*a*. The flange 127*a* comes into contact with the stop ring 157 thereby preventing the valve portion 127 from coming off from the spool portion 117. The flange 127*a* and the stop ring 157 correspond to the component members making up the coupling mechanism according to the invention.

Next, the operation and the effects of operation of the expander-integrated compressor 10, according to this embodiment, will be explained.

1. Pump Mode

This mode is an operation mode in which the swivel scroll 103 of the pump motor mechanism 100 is rotated by applying the turning effort to the shaft 108 thereby to suck in and compress the refrigerant.

Specifically, the operating valve 34 is opened with the liquid pump 32 stopped, and the engine cooling water is prevented from circulating to the heater 30 by operating the three-way valve 21. Also, the electromagnetic valve 107*e* is closed and the shaft 108 is rotated while the inflow port 106 is closed by valve unit 107*d*.

As a result, the expander-integrated compressor 10, like the well-known scroll compressor, sucks in the refrigerant from the low-pressure port 111 and compresses it in the working chamber V, after which the compressed refrigerant is discharged from the discharge port 105 into the high-pressure chamber 104. Thus, the compressed refrigerant is discharged to the heat radiator 11 from the high-pressure port 110.

In applying the turning effort to the shaft 108, the engine 20 and the expander-integrated compressor 10 are connected to each other mainly by the electromagnetic clutch 300 and the turning effort is applied by the power of the engine 20, or as an alternative, the engine 20 and the expander-integrated compressor 10 are separated from each other by the electromagnetic clutch 300 and the turning effort is applied by the rotary electric machine 200.

In the former case where the engine 20 and the expander-integrated compressor 10 are connected to each other by the electromagnetic clutch 300 and the turning effort is applied by the power of the engine 20, the electromagnetic clutch 300 is energized and connected while at the same time energizing the rotary electric machine 200 to generate a torque in the rotor 220 to such a degree as not to rotate the sun gear 401, i.e. the rotor 220.

In this way, the turning effort of the engine 20 transmitted to the pulley unit 310 is increased in speed by the speed change mechanism 400 and transmitted to the pump motor mechanism 100, so that the pump motor mechanism 100 is operated as a compressor.

In the case where the engine 20 and the expander-integrated compressor 10 are separated from each other by the electromagnetic clutch 300 and the turning effort is applied by the rotary electric machine 200, on the other hand, the electromagnetic magnetic clutch 300 is deactivated and turned off while the rotary electric machine 200 is energized to operate in the direction opposite to the direction in which the pulley unit 310 rotates. In this way, the pump motor mechanism 100 is operated as a compressor.

In the process, the shaft 331 (planetary carrier 402) is locked by a one-way clutch 500 and not rotated. The turning effort of the rotary electric machine 200, therefore, is transmitted to the pump motor mechanism 100 after deceleration by the speed change mechanism 400.

The refrigerant discharged from the high-pressure port 110 circulates (refrigeration cycle) through the heater 30, the operating valve 34, the heat radiator 11, the gas-liquid separator 12, the decompressor 13, the evaporator 14, the check valve 14*a* and the low-pressure port 111 of the expander-integrated compressor 10 in that order. In this way, the cooling operation (or the heating operation by heat radiation from the heat radiator 11) is performed by heat absorption of the evaporator 14. As the engine cooling water is not circulated in the heater 30, the refrigerant is not heated in the heater 30 and the heater 30 functions simply as a refrigerant path.

2. Motor Mode

In this mode, the high-pressure superheated vapor refrigerant heated by the heater 30 is introduced into the pump motor mechanism 100 through the high-pressure chamber 104 and is expanded. In this way, the swivel scroll 103 is swiveled to rotate the shaft 108 thereby to acquire the mechanical output.

According to this embodiment, the rotor 220 is rotated by the mechanical output thus acquired. Power is thus generated by the rotary electric machine 200 and stored in a capacitor.

Specifically, the liquid pump 32 is operated with the operating valve 34 closed, and by switching the three-way valve 21, the engine cooling water is circulated to the heater 30. Also, the electromagnetic clutch 300 of the expander-integrated compressor 10 is deactivated, and with the electromagnetic clutch 300 thus turned off, the electromagnetic valve 107*e* is opened. The inflow port 106 is opened by the valve unit 107*d*, and the high-pressure superheated vapor refrigerant heated by the heater 30 in the high-pressure chamber 104 is led through the inflow port 106 into the working chamber V and expanded. The refrigerant expanded and reduced in pressure flows out to the heat radiator 11 from the low-pressure port 111.

As a result, the expansion of the superheated vapor rotates the swivel scroll 103 in the direction opposite to the direction for execution of the pump mode, and the rotational energy applied to the swivel scroll 103 is transmitted to the rotor 220 of the rotary electric machine 200. In the process, the shaft 331 (planetary carrier 402) is locked by the one-way clutch 500 and not rotated, and therefore the turning effort of the swivel scroll 103 is transmitted to the rotary electric machine 200 at a speed increased by the speed change mechanism 400.

The refrigerant flowing out of the low-pressure port 111 is circulated (in the Rankine cycle) through the second bypass circuit 33, the check valve 33*a*, the heat radiator 11, the gas-liquid separator 12, the first bypass circuit 31, the check valve 31*a*, the liquid pump 32, the heater 30 and the expander-integrated compressor 10 (high-pressure port 110) in that order. In the liquid pump 32, liquid-phase refrigerant is pressured to a degree corresponding to the temperature of the superheated vapor refrigerant generated by being heated in the heater 30 and the resultant liquid-phase refrigerant is sent into the heater 30.

According to this invention, the valve unit 107*d* is divided into the spool portion 111 and the valve portion 127 and a swivel mechanism (the structure in which the protrusion of the valve portion 127 is inserted in the depression 117*c* of the spool portion 117) is arranged between the spool portion 117 and the valve portion 127, and, therefore, the sliding axis of the valve portion 127 can be tilted at an arbitrary angle with respect to the sliding axis of the spool portion 117. Even in the case where the perpendicularity of the sliding axis of the spool portion 117 with respect to the surface to which the communication path 106 opens is low in accuracy, therefore, the valve portion 127 can be brought into contact with the surface to which the communication path 106 opens, thereby improving the sealability.

Also, in view of the fact that the protrusion of the valve portion 127 is formed as a spherical surface with the hard ball 137, the tilt angle of the sliding axis of the valve portion 127 with respect to the sliding axis of the spool portion 117 can be smoothly changed.

The insertion of the hard ball 137 into the depression 117*c* makes it possible to set the spool portion 117 and the valve portion 127 in appropriate relative positions, thereby preventing the spool portion 117 and the valve portion 127 from being displaced from each other.

Also, in view of the fact that the piston ring 147 is arranged on the outer periphery of the spool portion 117, the pump motor mechanism 100 is operated in pump mode in such a manner that the refrigerant discharged into the high-pressure chamber 104 is prevented from leaking to the low-pressure port 111 through the electromagnetic valve 107*e* from the back pressure chamber 107*f*, thereby reducing the power loss of the expander-integrated compressor 10.

As the valve portion 127 is prevented from coming off from the spool portion 117 by the flange 127*a* of the valve portion 127 and the stop ring 157 of the spool portion 117, the valve unit 107*d* can be slid by a single drive means (electromagnetic valve 107*e*, spring 107*g*, etc.).

Figure 4:
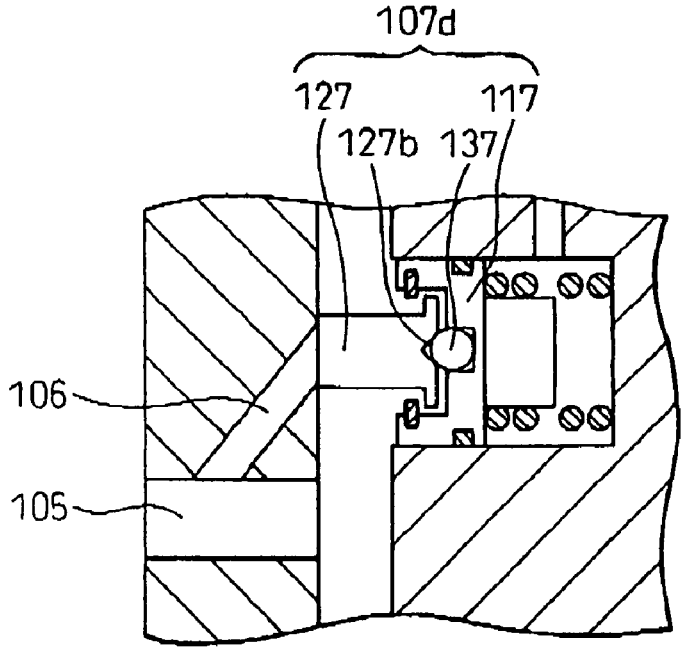
FIG. 4 is a sectional view showing a valve unit according to a second embodiment of the invention.
Figure 5:
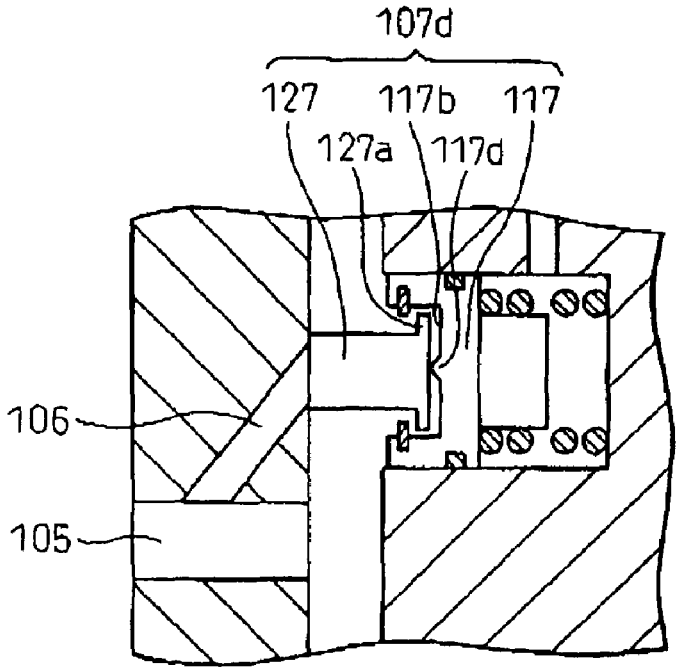
FIG. 5 is a sectional view showing a valve unit according to a third embodiment of the invention.
Figure 6:
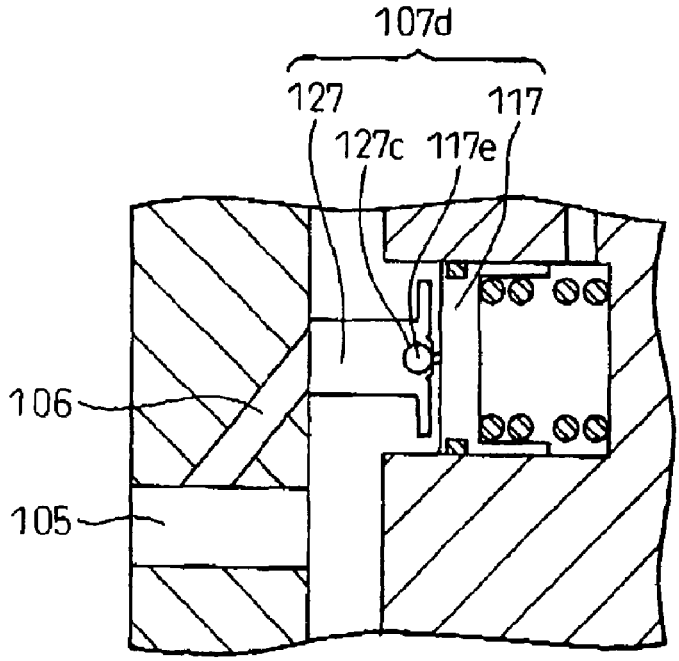
FIG. 6 is a sectional view showing a valve unit according to a fourth embodiment of the invention.

Additional embodiments of the invention are shown in FIGS. 4 to 6. In the embodiments of FIGS. 4 to 6, the configuration of the swivel mechanism is varied.

As shown in FIG. 4, the hard ball 137 is arranged on the spool portion 117 and the depression 127*b* is formed on the valve portion 127.

As another alternative, as shown in FIG. 5, the end surface portion on the flange 127*a* side of the valve portion 127 is kept flat, while the valve receiving surface 117*b* of the spool portion 117 is formed with a protrusion 117*d* having a thin forward end.

In still another embodiment, as shown in FIG. 6, the spool portion 117 has a ball portion 117*e*, and a spherical depression 127*c* is formed on the valve portion 127, so that the ball portion 117*e* and the depression 127*c* are formed as a universal joint with the spherical surfaces thereof in contact with each other. This configuration eliminates the stop ring 157 and can double as a coupling mechanism.

Figure 7:
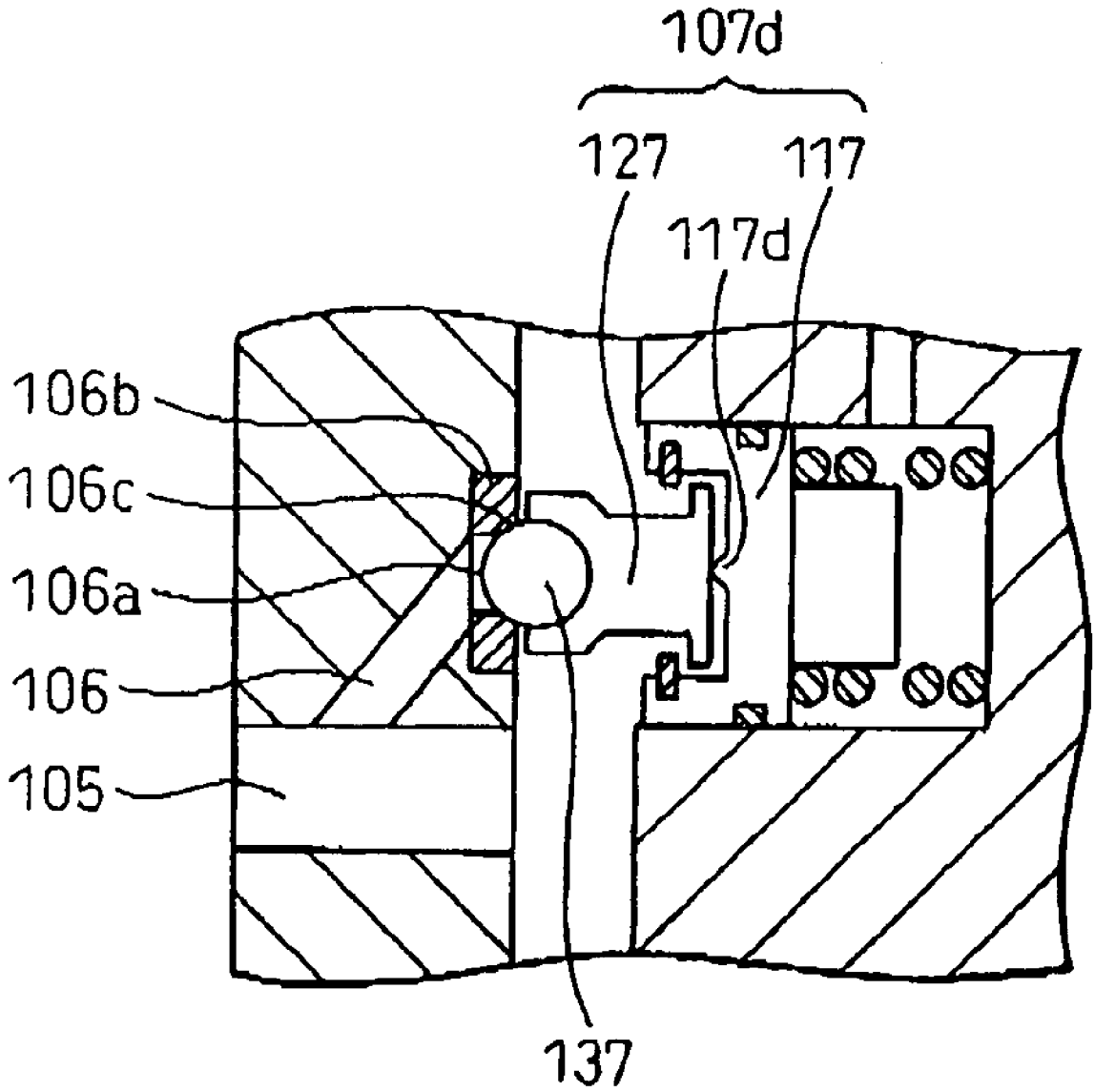
FIG. 7 is a sectional view showing a valve unit according to a fifth embodiment of the invention.

A further embodiment of the invention is shown in FIG. 7. According to the embodiment of FIG. 7, the shape of the opening of the inflow port 106 and the shape of the inflow port 106 side of the valve portion 127 are changed.

The inflow port 106 is formed diagonally to the sliding direction of the valve unit 107*d* and, therefore, the opening is elliptical in shape. At the opening of the inflow port 106 near to the side of the valve portion 127, a bush 106*b* having a round hole is arranged to make the opening 106*a* circular. A chamfer 106*c* is formed on the circumference of the opening 106*a*.

A hard ball 137 having a diameter larger than the opening 106*a* is fitted under pressure into the inflow port 106 side of the valve portion 127. When the valve unit 107*d* closes the inflow port 106, the swivel mechanism due to the protrusion 117*d* is operated while the hard ball 137 is brought into contact with the chamfer 106*c* of the opening 106*a*.

As a result, even in the case where the perpendicularity of the sliding axis of the valve unit 107*d* to the imaginary surface of the opening 106*a* is low in accuracy, the opening 106*a* and the spherical surface of the hard ball 137 come into positive contact with each other on the circumference (hermetic line contact) and, therefore, the sealability can be improved. Also, the material of the bush 106*b* conforming with the material of the valve unit 107*d* (specifically, the hard ball 137) can be selected, thereby further improving the sealability and durability.

Incidentally, as the hard ball 137 is fitted into the communication path 106, the dead space where the compressed refrigerant remains without being discharged can be reduced and, therefore, the operating efficiency of the expander-integrated compressor 10 is improved.

In the case where the relative positions of the opening 106*a* and the hard ball 137 are sufficiently secured, the swivel mechanism is not required and may be replaced with the valve unit 107*d* including the spool portion 117 and the valve portion 127 integrally formed with each other.

Figure 8:
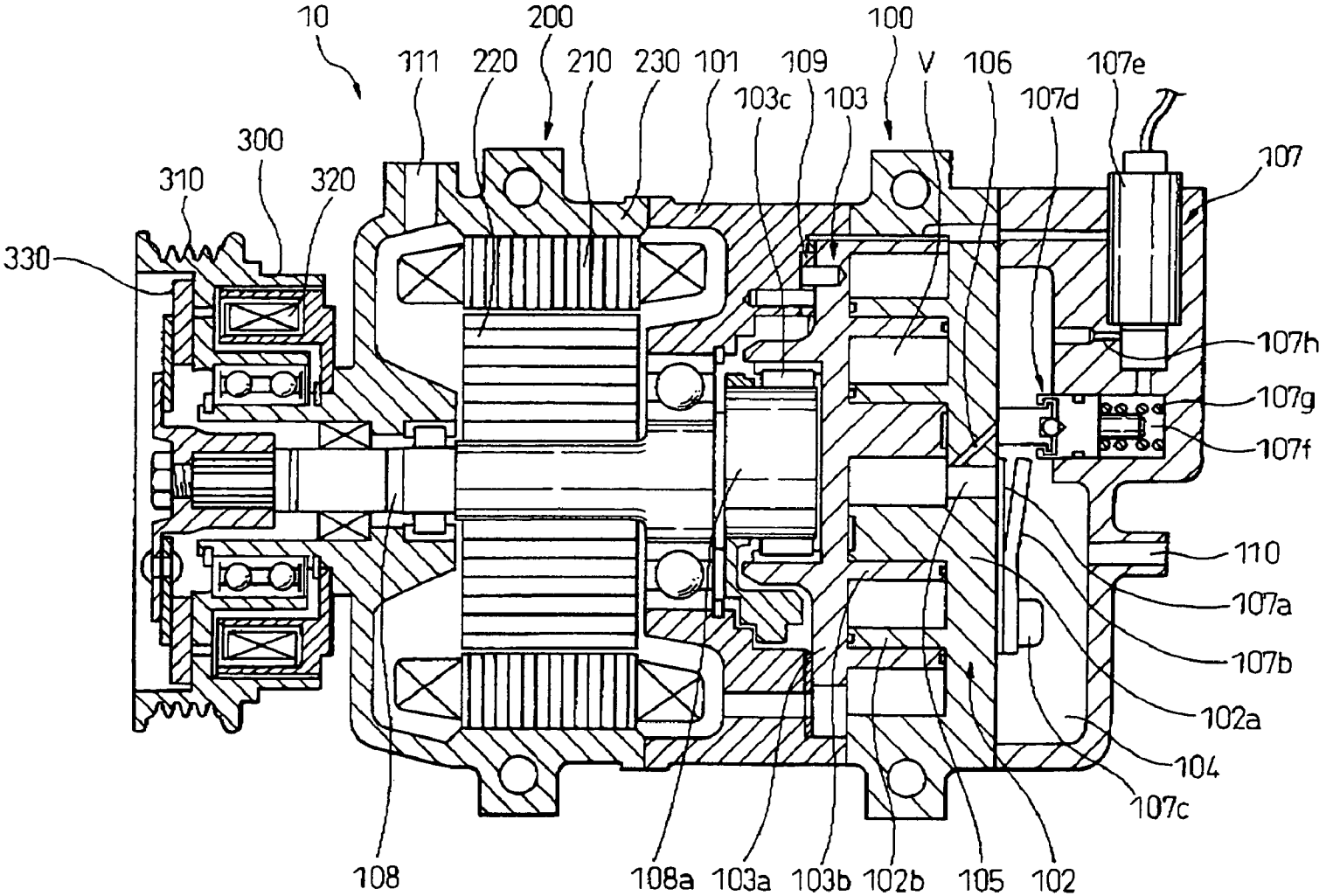
FIG. 8 is a sectional view showing an expander-integrated compressor according to a sixth embodiment of the invention.
Figure 9:
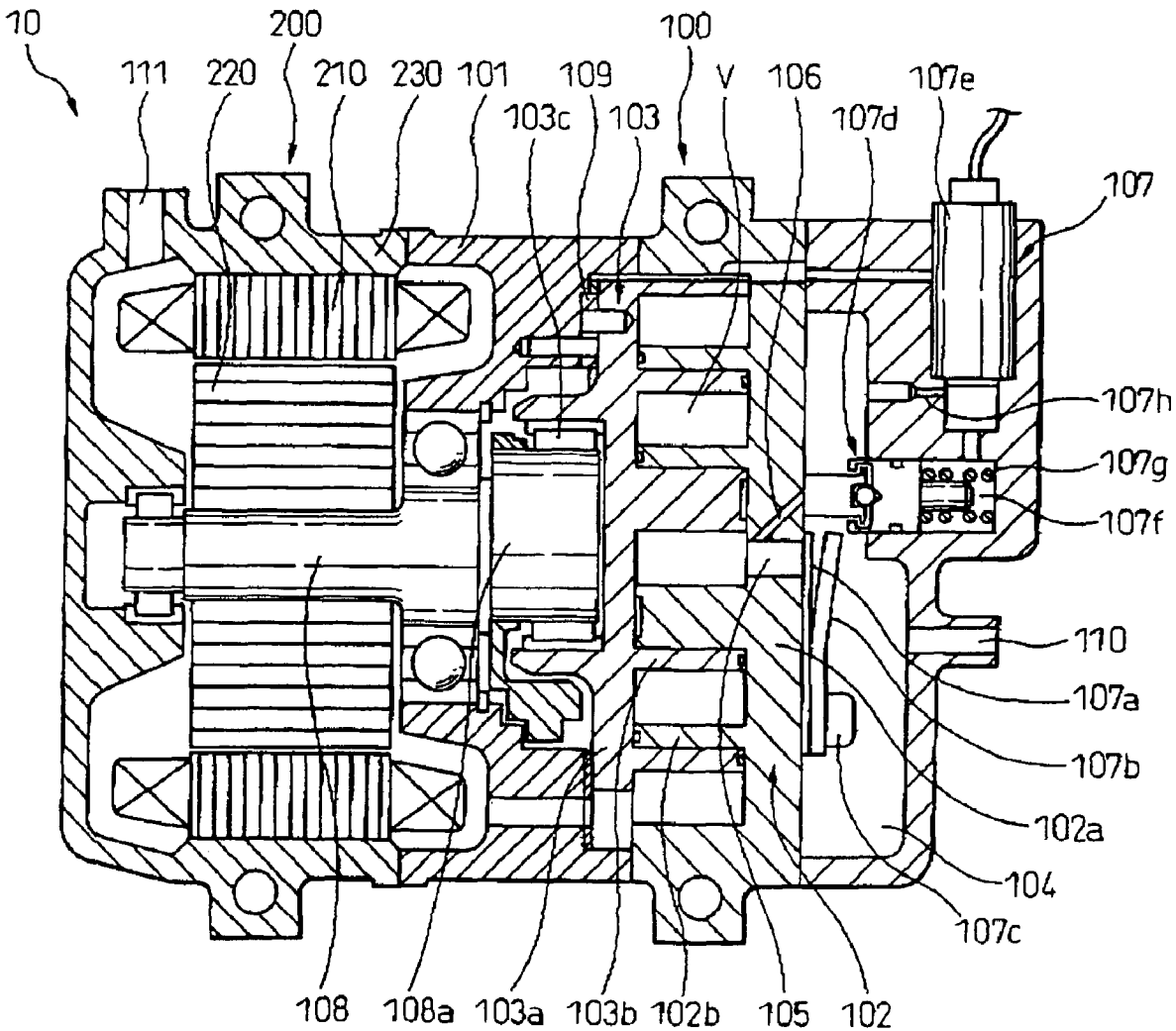
FIG. 9 is a sectional view showing an expander-integrated compressor according to a seventh embodiment of the invention.
Figure 10:
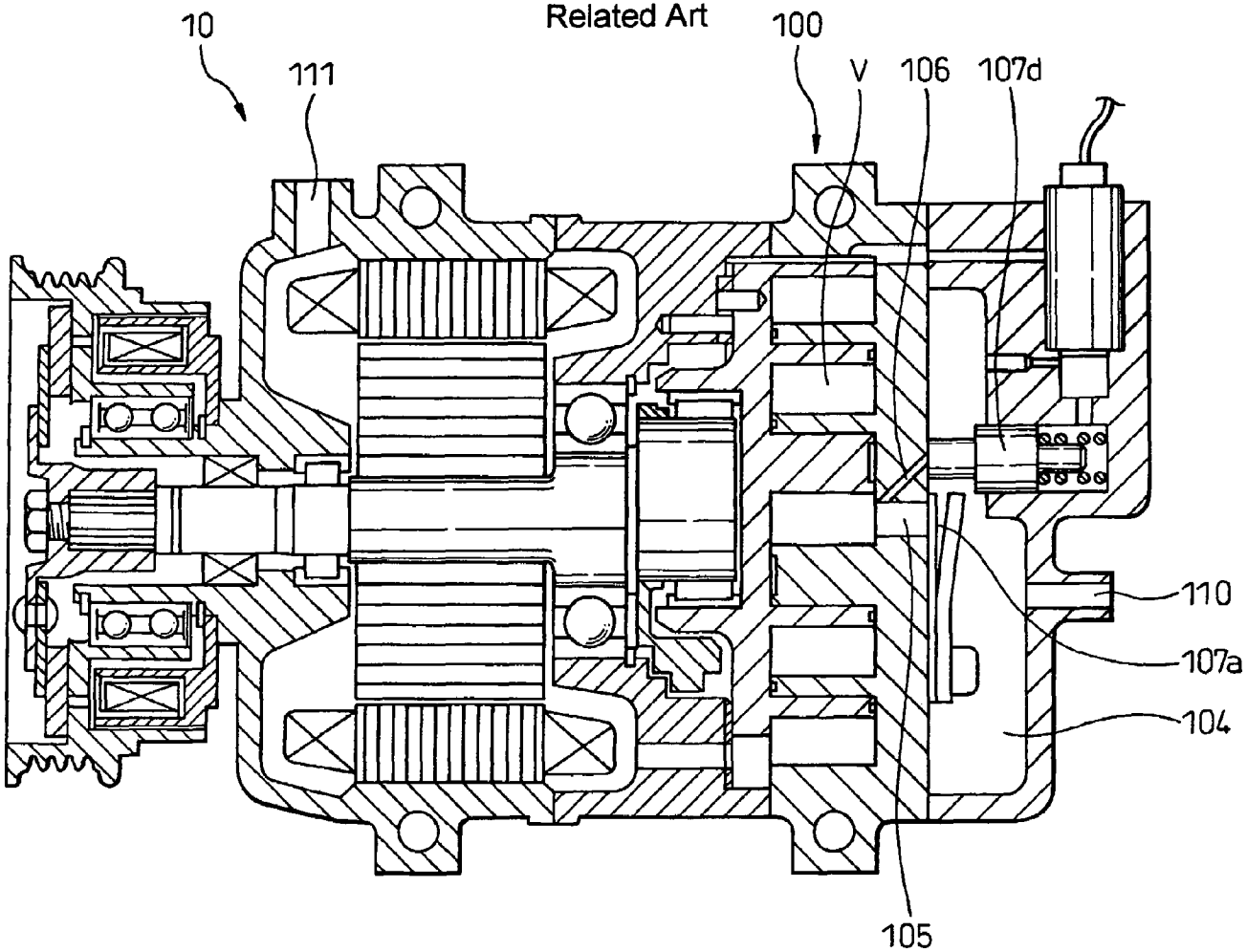
Fig.10 Related Art
FIG. 10 is a sectional view showing an expander-integrated compressor in the stage of test production.

The expander-integrated compressor 10 shown in FIGS. 8 and 9 may be used in place of the expander-integrated compressor 10 of the previous embodiments.

Specifically, in the expander-integrated compressor 10 shown in FIG. 8, the shaft 108 and the shaft 331 are integrated with each other (as a shaft 108), the speed change mechanism 400 is eliminated, and the pump motor mechanism 100, the rotary electric machine 200 and the electromagnetic clutch 300 are connected to the shaft 108. In the expander-integrated compressor 10 shown in FIG. 9, on the other hand, the electromagnetic clutch 300 is eliminated from the expander-integrated compressor 10 shown in FIG. 8.

In the embodiments described above, a pump motor mechanism 100 of a scroll type is employed. This invention is not limited to these embodiments, however, but is also applicable to the pump motor mechanism of rotary type, piston type, vane type and any other type with equal effect.

Also, according to the embodiments described above, the energy recovered by the expander-integrated compressor 10 is stored in a capacitor. As an alternative, the kinetic energy due to a flywheel or the elastic energy due to a spring may be stored as mechanical energy.

Further, although the fluid machine according to this invention is used for the vapor compression refrigerator having the Rankine cycle for automotive applications, the application of the invention is not limited to such a fluid machine.

While the invention has been described by reference to specific embodiments chosen for purposes of illustration, it should be apparent that numerous modifications could be made thereto, by those skilled in the art, without departing from the basic concept and scope of the invention.

The invention claimed is:

1. A switching valve structure of a fluid machine having a pump mode, to discharge a fluid under pressure, and a motor mode, to output mechanical energy by converting fluid pressure, at the time of expansion, into kinetic energy, wherein, in a case where the pump mode is executed, a communication path between a high-pressure chamber and a working chamber of the fluid machine is closed, and in a case where the motor mode is executed, the communication path is opened by a valve unit, wherein the valve unit includes a spool portion, which is adapted to slide in a direction substantially perpendicular to a surface to which the communication path is open on the valve unit side thereof, and a valve portion, which is arranged at the forward end of the spool portion, is located in the high-pressure chamber, and is adapted to slide with the spool portion for opening/closing the communication path, wherein a swivel mechanism, which is adapted to tilt the sliding axis of the valve portion with respect to the sliding axis of the spool portion at an arbitrary angle, is arranged between the spool portion and the valve portion, wherein in a case where the pump mode is executed, a discharge port conducts flow from the working chamber to the high-pressure chamber, and the discharge port is prevented from conducting flow from the high-pressure chamber to the working chamber by a check valve, which is adjacent to the valve unit in the high-pressure chamber, and wherein, in a case where the motor mode is executed, the valve unit opens the communication path, so that the communication path is open to flow from the high-pressure chamber to the working chamber.

2. A switching valve structure of a fluid machine having a pump mode to discharge a fluid under pressure and a motor mode to output the mechanical energy by converting the fluid pressure at the time of expansion into the kinetic energy, wherein in a case where the pump mode is executed, a communication path between a working chamber and a high-pressure chamber of the fluid machine is closed, while in a case where the motor mode is executed, the communication path is opened by a valve unit, wherein the valve unit includes a spool portion and a valve portion arranged at a forward end of the spool portion, and the valve portion is adapted to slide with the spool portion for opening/closing the communication path with a spherical end surface of the valve portion, wherein an opening on the valve unit side of the communication path is formed in the shape of a circle, wherein the valve unit slides in a direction substantially perpendicular to an imaginary surface of the opening, and wherein an opening side of the valve portion is formed as the spherical end surface, and the spherical end surface has a diameter larger than the opening, wherein a swivel mechanism, which is adapted to tilt the sliding axis of the valve portion with respect to the sliding axis of the spool portion at an arbitrary angle, is arranged between the spool portion and the valve portion and is located at the opposite end of the valve portion to an opening of the communication path, and wherein, in the pump mode, the valve portion is supported between the surface to which the communication path is open and the swivel mechanism.

3. A switching valve structure of a fluid machine according to claim 2, wherein the communication path is formed diagonally with respect to the sliding direction of the valve unit, and wherein the opening is formed as a circle with a bushing.

4. A switching valve structure of a fluid machine according to claim 3, wherein a chamfer is formed on the circumference of the opening.

5. A switching valve structure of a fluid machine according to claim 2, wherein a chamfer is formed on the circumference of the opening.

* * * * *